US006515630B2

(12) United States Patent
Honda

(10) Patent No.: US 6,515,630 B2
(45) Date of Patent: Feb. 4, 2003

(54) SLOT WEDGE ANTENNA ASSEMBLY

(75) Inventor: Royden Honda, San Jose, CA (US)

(73) Assignee: Tyco Electronics Logistics AG (CH)

( * ) Notice: Subject to any disclaimer, the term of this patent is extended or adjusted under 35 U.S.C. 154(b) by 0 days.

(21) Appl. No.: 09/877,165

(22) Filed: Jun. 8, 2001

(65) Prior Publication Data

US 2002/0021251 A1 Feb. 21, 2002

Related U.S. Application Data

(60) Provisional application No. 60/210,717, filed on Jun. 9, 2000.

(51) Int. Cl.[7] ..... H01Q 1/24; H01Q 1/38
(52) U.S. Cl. ..... 343/702; 343/700 MS
(58) Field of Search ..... 343/700 MS, 702, 343/767, 770; 455/89, 90

(56) References Cited

U.S. PATENT DOCUMENTS

| | | | | | |
|---|---|---|---|---|---|
| 5,148,181 | A | * | 9/1992 | Yokoyama et al. | 343/700 MS |
| 5,926,139 | A | * | 7/1999 | Korisch | 343/700 MS |
| 6,008,762 | A | * | 12/1999 | Nghiem | 343/700 MS |
| 6,100,849 | A | * | 8/2000 | Tsubaki et al. | 343/702 |
| 6,218,991 | B1 | * | 4/2001 | Sanad | 343/700 MS |
| 6,346,914 | B1 | * | 2/2002 | Annamaa | 343/700 MS |

* cited by examiner

*Primary Examiner*—Tan Ho
(74) *Attorney, Agent, or Firm*—Fulbright & Jaworski L.L.P.

(57) ABSTRACT

A resonator element for use with a wireless communication device. The resonator element is substantially splayed and includes first and second conductive portions which are in divergent relation and which are operatively connected to each other by a conducting element. The first conductive portion includes a ground attachment member and a feed attachment member which may be operatively connected to a ground plane and a radio frequency input/output port, respectively. The resonator also includes an angled slot which extends through the first conductive portion, the conducting element, and partially into the second conductive portion. A significant feature of the present invention relates to the sizing of the slot portion of the resonator element. This slot is much smaller than the wavelength of incident radiation, which is a major advantage over previous, prior art slot antenna designs. In a most preferred embodiment, the resonator element from which the slot is cut out or otherwise removed or formed during fabrication of the resonator element is preferably less than one-eighth (⅛) of the operational wavelength of the 824 to 894 MHz frequency band for which the resonator element is preferably tuned. In order to tune the resonator element (or entire antenna assembly) to a different frequency band of operation, the dimensions for the operative features of the resonator element would be adjusted proportionally.

17 Claims, 5 Drawing Sheets

SLOT WEDGE ANTENNA ASSEMBLY

This application for utility patent coverage in the United States of America hereby incorporates by reference and claims the benefit of the entire contents and filing date accorded the following provisional patent application earlier filed with the U.S. Patent and Trademark Office; namely, U.S. Provisional Application No. 60/210,717 filed Jun. 9, 2000, entitled "Slot Wedge Antenna Assembly."

FIELD OF THE INVENTION

The present invention relates to an antenna assembly suitable for wireless transmission and receipt of analog and/or digital data, and more particularly to an antenna assembly for use with diverse wireless communication devices.

BACKGROUND OF THE INVENTION

There are a variety of antennas which are currently used in wireless communication devices. One type of antenna is an external half wave single or multi-band dipole. This antenna typically extends or is extensible from the body of a wireless communication device in a linear fashion during normal operation. Because of the physical configuration of this type of antenna, it is relatively insensitive to directional signal optimization. In other words, it is able to operate in a variety of positions without substantial signal degradation and is considered omni-directional. There is essentially no front-to-back ratio (with respect to a wireless communication device) and little or no Specific Absorption Rate (SAR) reduction with this type of antenna. A typical specific absorption rate for such antennas is 2.7 mw/g at a 0.5 watt transmission power level. With multi-band versions of this type of antenna, where resonances are achieved through the use of inductor-capacitor (LC) traps, gains of +2 dBi are common.

While this type of antenna is acceptable in some wireless communication devices, it has drawbacks. One significant drawback is that the antenna is external to the body of the communication device. This places the antenna in an exposed position where it may be accidentally or deliberately damaged.

A related antenna is an external quarter wave single or multi-band asymmetric wire dipole. This antenna operates much like the aforementioned antenna, but requires an additional quarter wave conductor to produce additional resonances and has drawbacks similar to the aforementioned half wave single or multi-band dipole antenna.

Another type of antenna is the internal single or multi band asymmetric dipole. This type of antenna usually features quarter wave resonant conductor traces, which may be located on a planar printed circuit board within the body of a wireless communication device. Such antennas typically operate over one or more frequency ranges with gains of +1–2 dBi. They also have a slight front-to-back ratio. This antenna may include one or more feed points for multiple band operation, and may require a second conductor for additional band resonance.

Yet another antenna is an internal or single multi-band Planar Inverted "F" Antenna (PIFA). This type of antenna features a single or multiple resonant planar conductor that operates over a second conductor or ground plane. With this type of antenna, gains of +1.5 dBi are typical. Front-to-back ratios and SAR values are a function of frequency.

Thus, there exists a need for an antenna assembly which is compact, lightweight and which may be incorporated into a variety of wireless communication devices.

There also exists a need in the art for new varieties of such antenna assemblies that receive and transmit data over two or more distinct frequency bands.

There also exists a need in the art for new varieties of such antenna assemblies that conform to the available interior spacing within a wireless communication device.

A further need exists in the art to maximize use of all available interior volume of a wireless communication device for circuitry used to transmit and receive data and the present invention addresses this need by providing, in one embodiment, additional interior volume for such circuitry to be mounted between operative components of the resonator element and the ground plane of antenna assemblies fabricated according to the present invention.

SUMMARY OF THE INVENTION

The present invention as set forth in this disclosure teaches, enables, discloses, illustrates and claims herein a new, useful and non-obvious compact, resonant, slot wedge antenna for wireless communication devices (WCD). The antenna assembly according to the present invention preferably includes the following properties, features and characteristics:

- Compact size suitable to integration within a WCD, including without limitation, a telephone device, a personal digital assistant (PDA), and a laptop computer as well as other diverse wireless devices which transmit and receive data via an antenna assembly;
- Minimized operational interference by placement of the antenna in a preferred location disposed in an upper portion of the WCD;
- Suitable for mounting entirely within the housing of a compact WCD;
- Suitable for mounted directly to a related printed wiring board disposed within the interior space of a WCD using known surface mounting techniques;
- Robust physical package, or assembly envelop, characterized by having rigidly fixed components and eliminating external appendages of a WCD; and,
- Enhanced performance at U.S. cellular frequency range of 824 to 894 MHz as depicted in the appended drawings and with reference to the detailed description of the preferred embodiment of the present invention.

A significant feature of the present invention relates to the sizing of the slot portion of the resonator element. This slot is much smaller than the wavelength of incident radiation, which is a major advantage over previous, prior art slot antenna designs. In a most preferred embodiment, the resonator element from which the slot is cut out or otherwise removed or formed during fabrication of the resonator element is preferably less than one-eighth (⅛) of the operational wavelength of the 824 to 894 MHz frequency band for which the resonator element is preferably tuned. In order to tune the resonator element (or entire antenna assembly) to a different frequency band of operation, the dimensions for the operative features of the resonator element must be adjusted proportionally.

A resonator element for use in conjunction with a ground plane of a wireless communication device according to the present invention includes first and second conductive portions which are operatively connected to each other by an electrically conducting connector element which electrically couples and preferably supports the conductive portions in a desired configuration relative to each other. A particularly preferred configuration of the two conductive portions form an open clam shell-type shape, or wedge shape, with the electrically conducting connector element supporting the first conductive portion at an angle from the second conductive element so that a proximal end of each conductive portion couples to the connector element and a distal end of each conductive portion are spaced apart. This particularly preferred configuration and orientation provides an open space between the first and second conductive portion. This open space provides useful additional mounting locations for circuitry, electrical interconnections and the like for components sized to be positioned or coupled therein to thereby facilitate the overall compact construction of the WCD to which the inventive antenna assembly is coupled.

The first conductive portion includes a ground feed attachment member and a signal feed attachment member which may be operatively connected to a ground plane and a radio frequency signal input/output port, respectively. The resonator also includes a slot, or notch, feature formed therein and preferably extending across the first conductive portion, the electrically conducting connector element, and partially across the second conductive portion. The reader should appreciate that the inventive antenna assembly may be fabricated, or stamped, from a section of electrically conducting sheeting (metal, conducting polymer, or other materials plated or coated with conducting material either prior to, or following any applicable plating or coating procedures). In the event that the antenna assembly is fabricated, or stamped, from such a sheet of material, then the first conductive portion, the electrically conducting connector element, and the second conductive portion shall comprise a single conductive element.

In a particularly preferred embodiment, the first conductive portion, the second conductive portion and the electrically conducting connector element of the resonator element are formed as a unitary structure, which may be formed using known technologies and techniques, such as metal stamping, metallic deposition on a dielectric substrate, photo-resist and etching, electroless plating of diverse non-conducting resin-based material and the like. The resonator element may be formed by shaping and manipulating sheet metals such as brass, tin over steel, aluminum, or other suitably conductive material. Preferably, the resonator element comprises brass formed into a sheet and having a thickness of around 16 mils. Alternatively, it will be appreciated that the first conductive portion, the second conductive portion and the conducting element of the resonator element may be formed separately and then assembled into a unitary structure.

The resonator element works in concert with a ground plane of a wireless communication device, with the ground plane integrally formed as a part of a printed wiring board. Preferably, the first conductive portion of the resonator element is attached to the printed wiring board by known technologies and techniques. From there, the ground attachment member and the feed attachment members are operatively connected to a ground plane and a radio frequency input/output signal port, respectively. It should be noted that the ground and feed attachment members should be electrically insulated or else they would short circuit and may not be electrically coupled to the ground plane and/or the input/output signal port. It is understood that suitable insulated and/or shielded connectors such as cables, microstrips, traces, or the like may be used. To optimize performance, the resonator element is positioned in a predetermined area which is less likely to be covered or overlaid by a hand of a user or otherwise covered during operation of the associated device. In the typical device such a location for the slot wedge antenna assembly of the present invention is adjacent the top of the wireless communication device.

It is an object of the present invention to provide an antenna assembly which may be incorporated into a wireless communication device.

Another object of the present invention is to enhance implementation of an antenna assembly by enabling the bandwidth to be adjusted by manipulating the resonator element.

Yet another object of the present invention is to enable the antenna assembly to be configured to operate at one or more preselected signal frequencies and signal bandwidths.

A feature of the present invention is that the operational bandwidth may be preselected by varying physical parameters of the resonator element either singularly or in combination with each other.

Another feature of the present invention is that the operational signal frequency may be determined and tuned by simply varying physical parameters of the resonator element either singularly or in combination with other physical parameters of the resonator element.

Another feature of the present invention is that there is a single feed point for electromagnetic frequencies.

Yet another feature of the present invention is that fabrication may be accomplished through existing technologies and mass production techniques.

Still another feature of the present invention is that portions of the antenna may be removed to accommodate various components disposed within or proximate to the resonator element and/or the ground plane of antenna assemblies fabricated according to the present invention.

An advantage of the present invention is that the antenna assembly has a low profile which enables it to be used in small articles such as wireless communication devices.

Another advantage of the present invention is that various components of a transceiver device may be positioned within interior regions of the antenna assembly to reduce the overall size of the electronic device, whether or not portions of said assembly are removed to accommodate such various components placement.

These and other objects, features and advantages will become apparent in light of the following detailed description of the preferred embodiments in connection with the drawings.

DETAILED DESCRIPTION OF THE PREFERRED EMBODIMENTS

Figure 1:
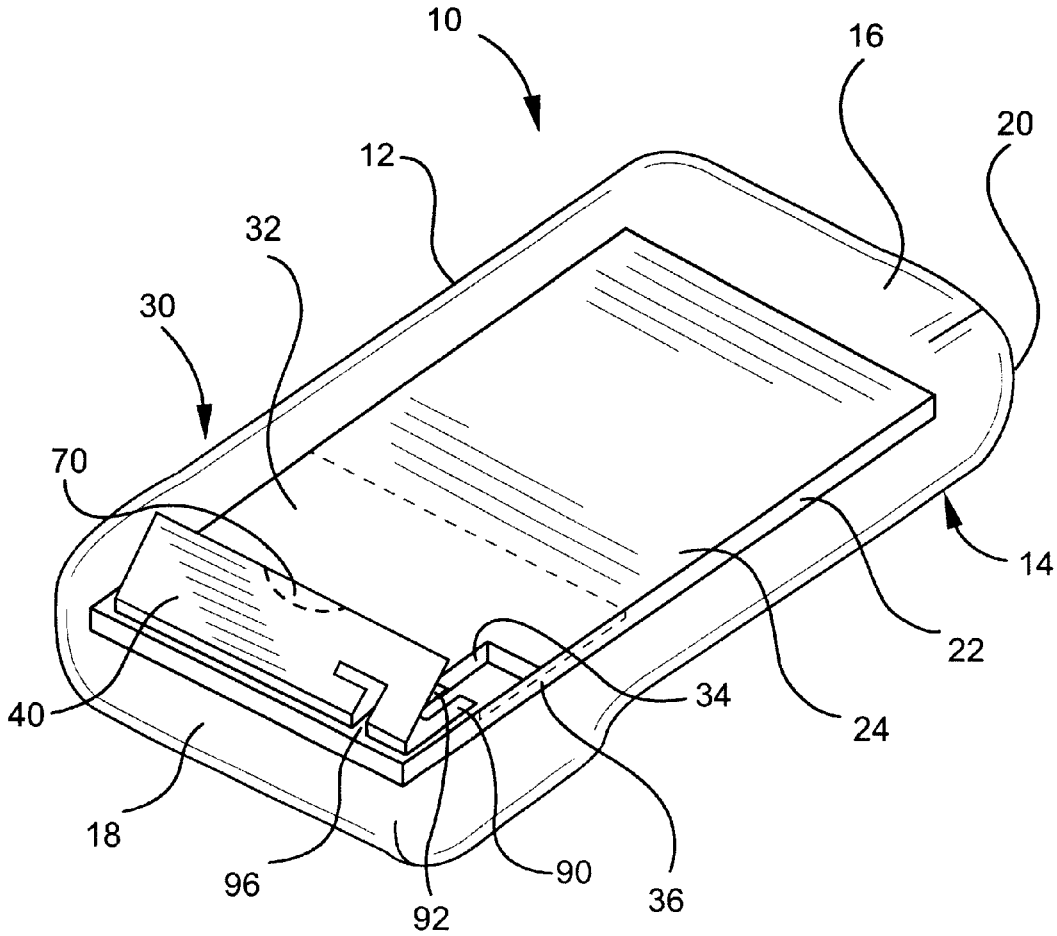
FIG. 1 is a perspective view, with certain sub-components not illustrated for ease of reference, of a wireless communication device incorporating an embodiment of an antenna assembly according to the present invention.

Referring now to the drawings, wherein like numerals depict like parts throughout, FIG. 1 illustrates a wireless communication device (WCD) 10 having a housing 12 with a front 14, a rear or back 16, a top 18, a bottom 20 and a printed wiring board (PWB) 22 disposed within said housing 12. In FIG. 1, certain portions of the WCD 10 have been omitted to illustrate the juxtaposition of an antenna assembly 30 as it resides within the housing 12. The antenna assembly 30 comprises a resonator element 40 and the ground plane 24 is preferably disposed on a printed wiring board 22. As depicted, the resonator element 40 is located adjacent the top 18 of the housing 12. This position optimizes operation because of the WCD 10 because it is an area which is not normally grasped by a human operator during use of the WCD 10. As can be seen, this preferred position corresponds to a predetermined electrically insulated region 32 on the printed wiring board 22. The electrically insulated region 32 on the printed wiring board 22 is not only electrically insulated from other components, but also preferably devoid of contact with any exposed portions of an electrically conducting ground plane 24 disposed in the WCD 10.

Figure 2:
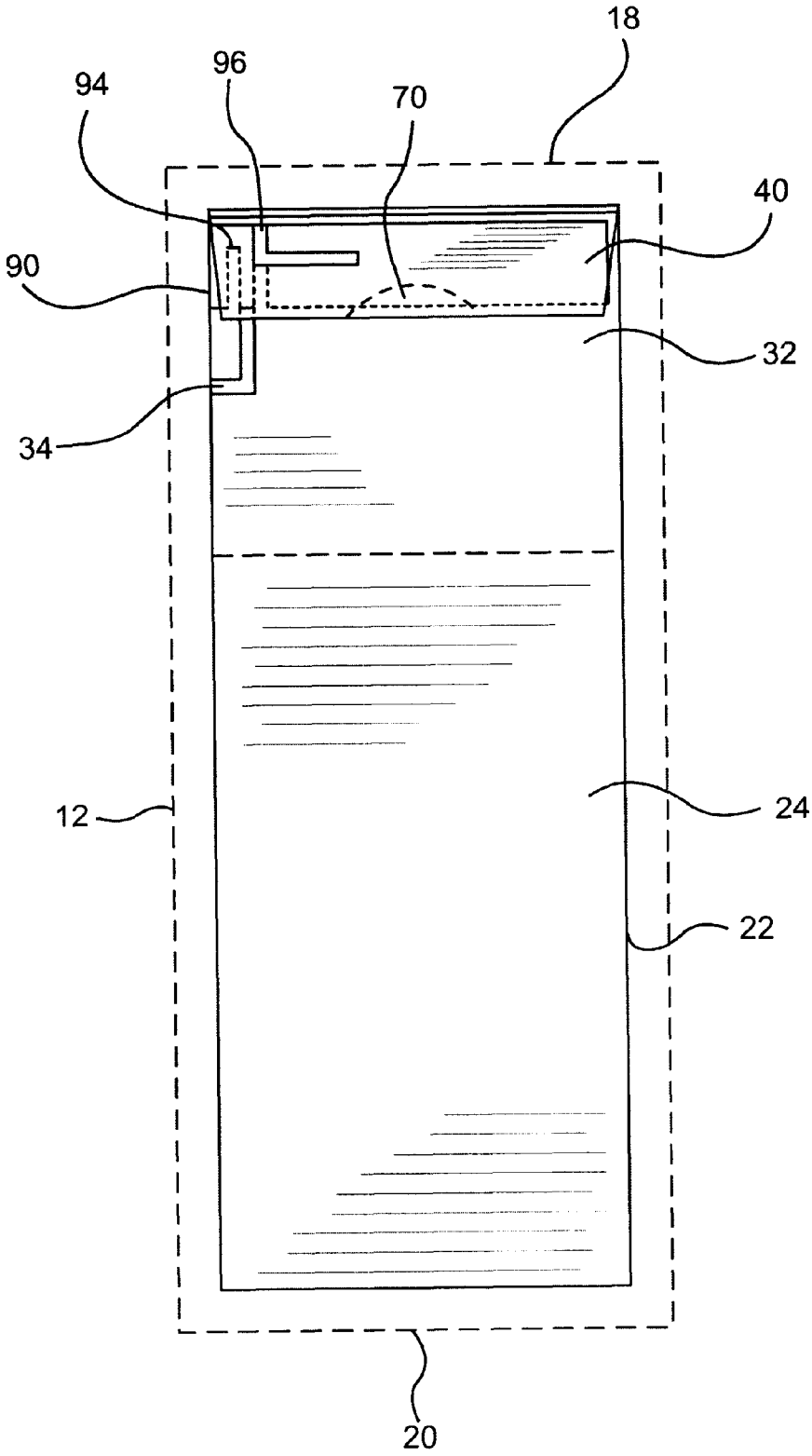
FIG. 2 is a plan view of the antenna assembly according to the present invention with a housing for a wireless communication device depicted in phantom.

As depicted in FIG. 2, the resonator element 40 is positioned within the electrically insulated region 32 of the printed wiring board 22 and preferably attached thereto with solder to soldering pads (not shown) disposed between resonator element 40 and the printed wiring board 22. As mentioned previously, this electrically insulated region 32 corresponds to a portion of the WCD 10 which is not normally grasped or otherwise covered by a user during data transmission and reception by the WCD 10. It will be appreciated that the resonator element 40 may be positioned at other locations within housing 12, however, though its operation may be less than optimal. For example, the resonator element 40 may be rotated ninety degrees relative to the configuration depicted in FIG. 2 and attached along a side of the printed wiring board 22, but would then require re-tuning to optimize performance of the resonator element 40 in the new location relative to the ground plane 24 of the printed wiring board 22. In a further refinement of such an edge-mounted resonator element 40, resonator element 40 may be disposed relative to he printed wiring board 22 so that the resonator element 40 in effect straddles the printed wiring board 22 and thus, at least a portion of the printed wiring board 22 is disposed between at least a portion of an overlapping part of the first conductive portion 50 and the second conductive portions 60 (See FIG. 4). Again, the resonator element 40 would require re-tuning to optimize performance thereof in the new location relative to the ground plane 24 of the printed wiring board 22. In another embodiment having a different configuration between the resonator element 40, conductive portion 50 and the printed wiring board 22, the first conductive portion 50 is disposed in orthogonal relation (not shown) to the printed wiring board 22 so they mutually form a "T" shape. Once again, the resonator element 40 would require re-tuning to optimize performance thereof in the new location relative to the ground plane 24 of the printed wiring board 22. The resonator element 40 may be attached or affixed to the printed wiring board 22 in other conventional manner in lieu of solder and solder pads, for example, via use of adhesives or with a mechanical coupling and the like. The region 32 may be electrically insulated and/or the surface of the resonator element 40 which overlaps region 32 may be rendered non-conducting to reduce the possibility of unintended electrical coupling between any components disposed on region 32 and the resonator element 40. If either region 32 or such surface of resonator element 40 are rendered non-conducting, electrically conducting connectors may be used such as cables, microstrips, conducting trace materials and the like may be provided to electrically couple the various components as required to operate the WCD. For example, as best depicted in FIG. 4 and FIG. 5, a first electrically conducting trace 34 and a second electrically conducting trace 36 may be used to establish an electrical connection for the resonator element 40 and the ground plane 24, respectively.

Figure 3:
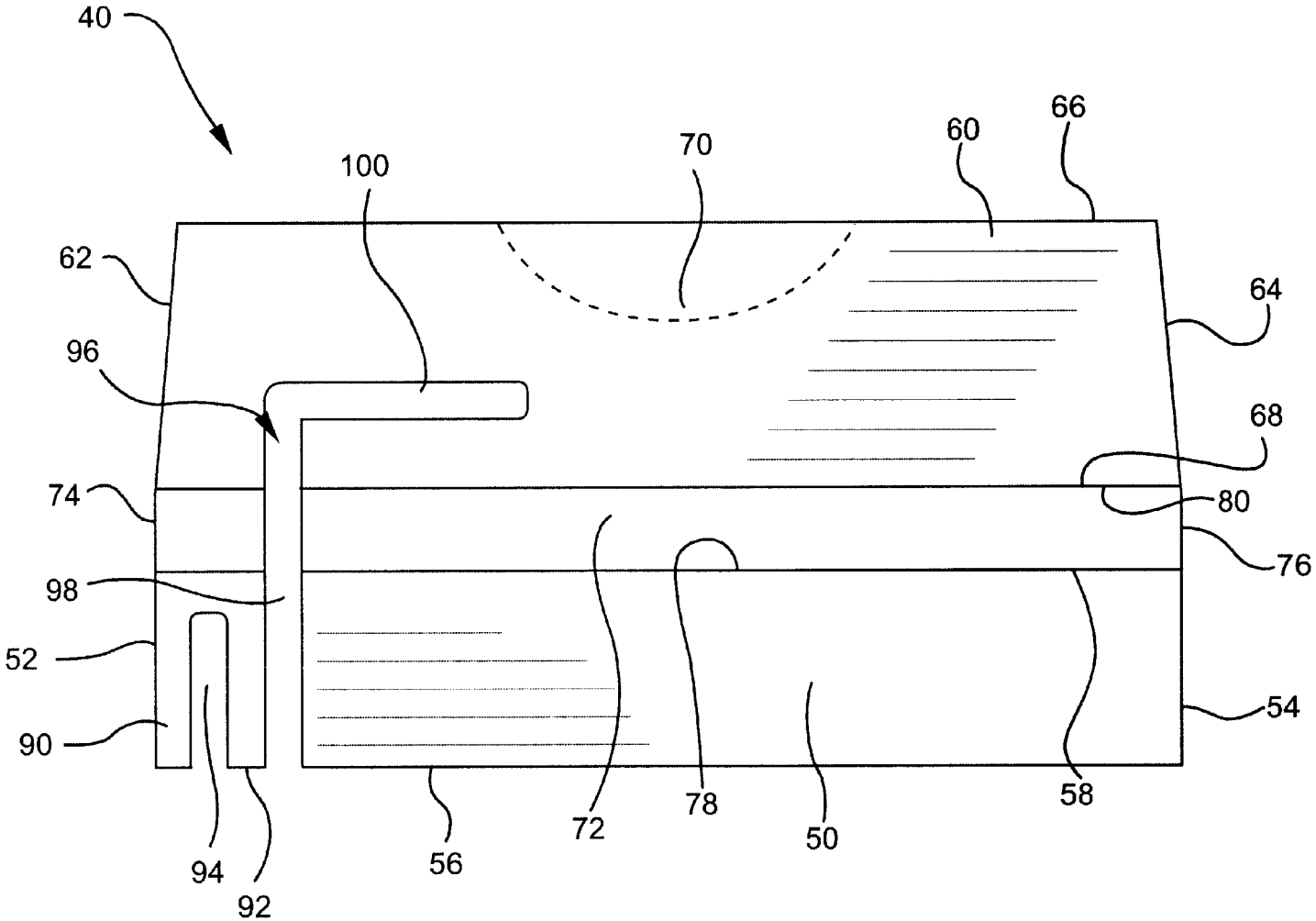
FIG. 3 is a plan view of the resonator element of FIG. 1 taken during the formation process.
Figure 4:
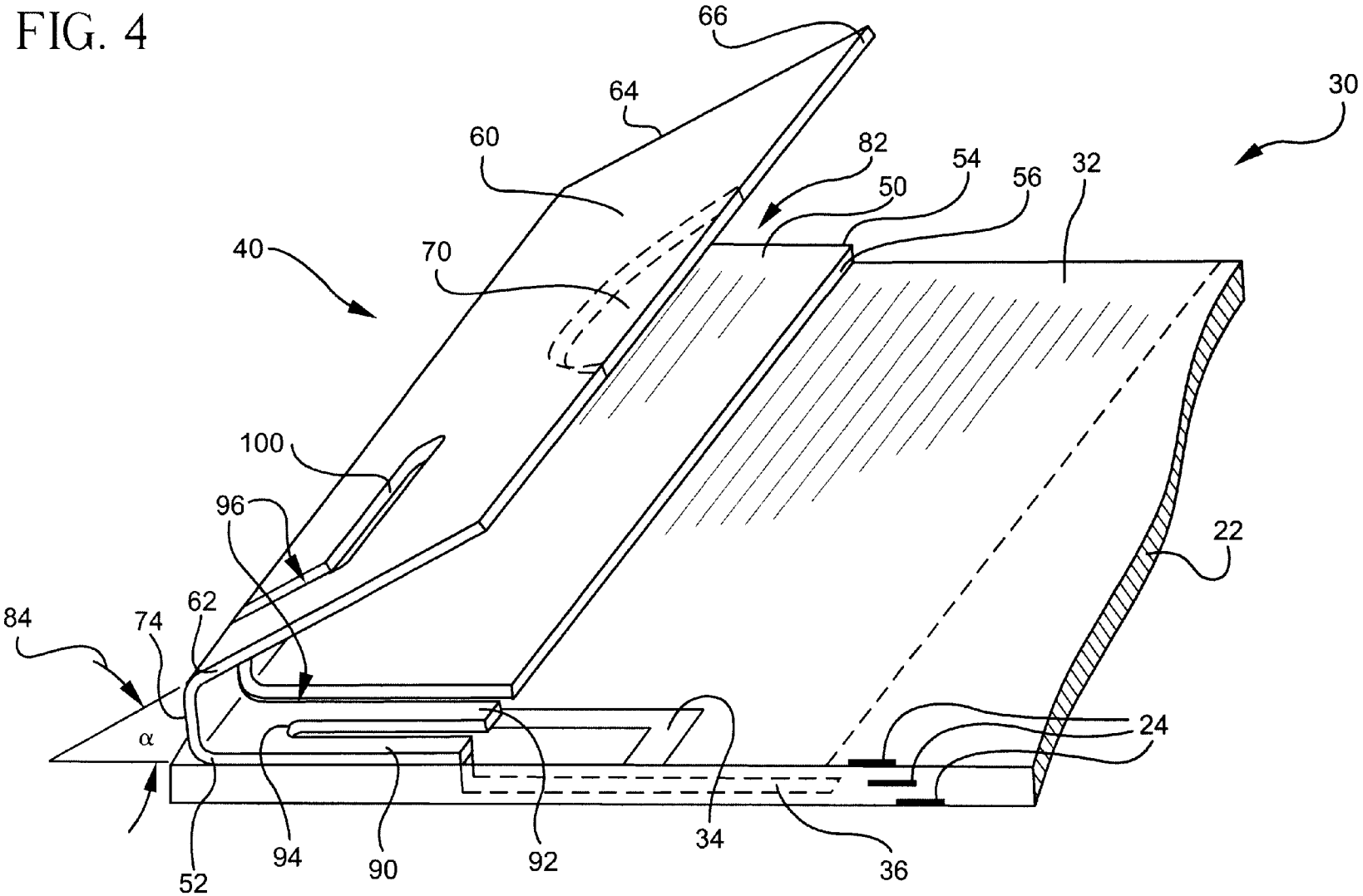
FIG. 4 is a partial perspective view primarily of the antenna assembly of FIG. 1 with some parts not depicted.
Figure 5:
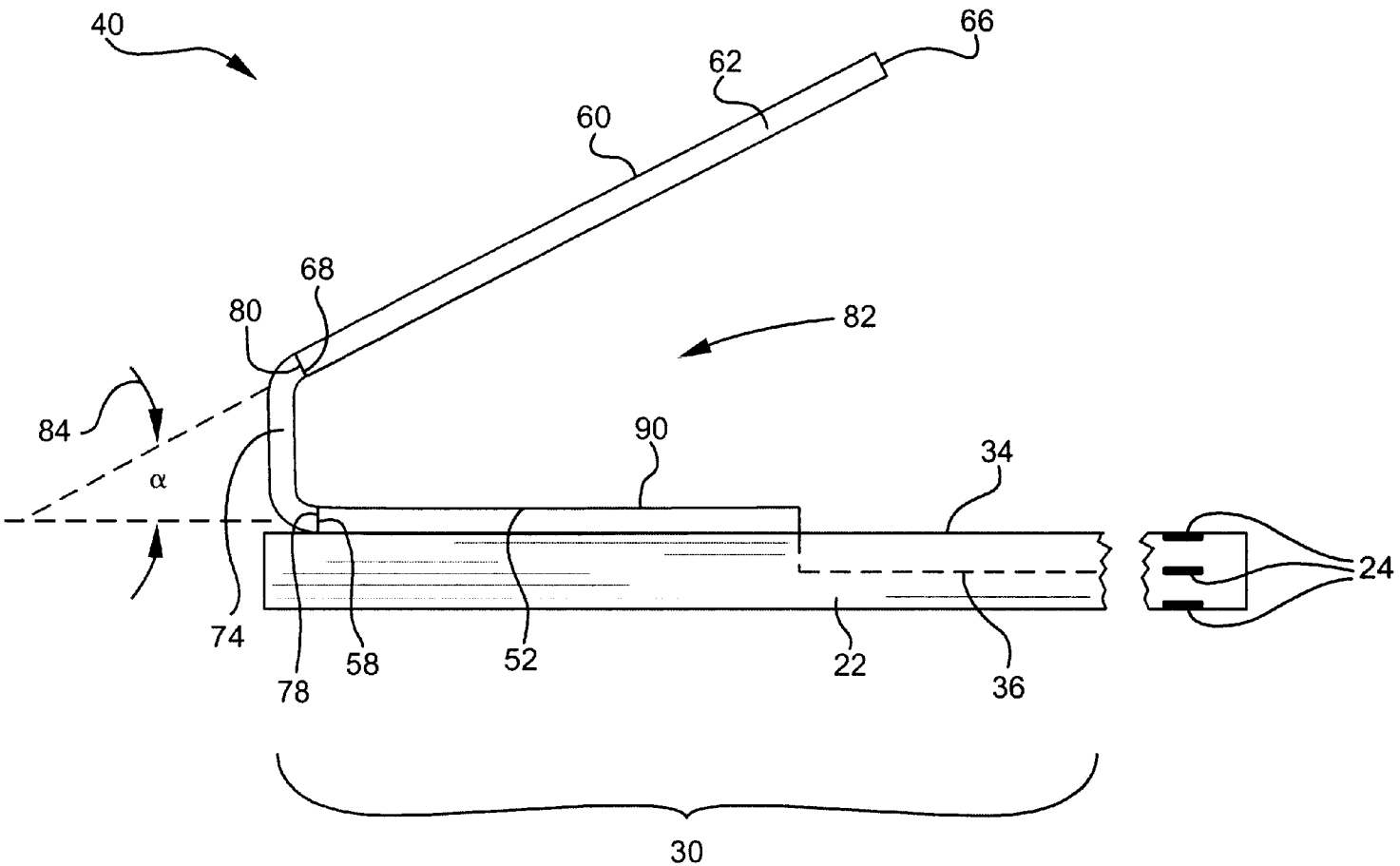
FIG. 5 is an elevational side view primarily of the antenna assembly of FIG. 1 with some parts not depicted.

Important inventive details of the resonator element 40 are disclosed with particular reference to FIG. 3, FIG. 4 and FIG. 5. In FIG. 3, the resonator element 40 has been partially shaped but has not been manipulated into its final configuration. Generally, the resonator element 40 includes a first conductive portion 50, a second conductive portion 60 and an electrically conducting connector element 72 which electrically couples the first conductive portion 50 to the second conductive portion 60. More specifically, the first conductive portion 50 and the conducting element 72, may be each generally rectangular in shape and includes sides 52,54,56, 58 and edges 74,76,78, 80 respectively, while the second conductive portion 60 is generally trapezoidal in shape and includes sides 62, 64 and edges 66, 68. The conducting element 70 operatively connects the first conductive portion 50 and the second conductive portion 60 together at common edges 58/78, and 68/80 to form a unitary structure. Note, in this preferred embodiment, that the common edges serve as fold lines. As noted herein, manually deformable electrically conductive material such as metal in sheet form readily lends itself as a material suited for fabrication of the resonator element 40. In accordance with the present invention, more than one resonator element 40 may be electrically coupled to the printed wiring board 22 although the operability of such configurations are typically subject to practical concerns and the limited available "real estate" afforded resonator element 40 within housing 12 and, in addition, if more than one resonator element 40 is coupled to printed wiring board 22, the orientation of a first and a second such resonator element 40 must be accounted for to optimize performance of this embodiment. While mounting resonator element 40 internal to a WCD 10 is greatly preferred, the teaching of the present invention may be successfully applied to externally mounted antenna assemblies, or antenna assemblies having a portion thereof protruding or extending outside of housing 12.

In FIG. 4 and as mentioned above, the first conductive portion 50 is attached or affixed to the printed wiring board 22 and preferably includes a ground feed attachment location 90 and a radio frequency signal attachment location 92 which are operatively connected to the ground plane 24 and a radio frequency input/output signal port (not shown) via traces 36,34, respectively. The ground feed and radio frequency signal feed attachment locations 90,92 are preferably created by the formation of a notch feature 94 and a slot feature 96 in the resonator element 40. The notch feature 94 and the slot feature 96 may both preferably originate at edge 56 of the first conductive portion 50 and respectively terminate within the periphery of the first conductive portion 50 and the second conductive portion 50,60. The notch feature 94 and a first slot segment 98 of the slot feature 96 are substantially parallel to each other and preferably extend in a substantially orthogonal direction from the edge 56 from which they both preferably originate. The slot feature 96 preferably has a second slot segment 100 which is preferably formed to extend from the end of, and substantially perpendicular to, the longitudinal axis, or centerline, of the first slot segment 98.

The second conductive portion 60 is preferably somewhat trapezoidal in shape, with the sides 62,64 converging towards each other as they approach edge 66. While not required to practice the teaching of the present invention, the major surfaces of the second conductive portion 60 are preferably substantially planar, or flat. If second conductive portion 60 is concave, convex or possesses a compound curving topography, then tuning of resonator element 40 will be required for each of the non-planar curves in order for the antenna assembly 30 to operate in a sufficiently useful manner.

A feature of the resonator element 40 is that portions may be removed without disrupting or otherwise altering the operational characteristics of an appropriately tuned antenna assembly 30. For example, a portion of the second conductive portion 60 may be removed at cut 70 to accommodate various components that extend from region or space 32 toward the second conductive portion 60. For example, the cut-out 70 may be disposed at other locations of the second conductive portion 60 or more than one such cut-out portion may be present on said second conductive portion 60 although additional re-tuning of the antenna assembly 30 will be required to optimize the operation thereof assuming that the embodiments depicted in the FIG. 3 were already tuned prior to the added, or moved, cut-out portion 70. Furthermore, features similar to cut-out 70 may be included in the first conductive portion 50 for the same reasons such a feature may be present on the second conductive portion 60 (e.g., to accommodate additional or various electrical components which are coupled to the printed wiring board 22) or otherwise used by WCD 10.

Turning to FIGS. 4 and 5, the resonator element 40 of FIG. 3 has been manipulated and attached to the predetermined region of the printed wiring board 22 in a conventional manner to form the antenna assembly 30. As mentioned previously, the manipulation may take the form of bending along fold lines. Note that the second conductive portion 60 is spaced from the first conductive portion 50 in a skewed or non-parallel relation at an angle 84. Note also, that the first and second conductive portions 50, 60 create an open space or interior region 82 into which various electrical and electronic components and the like may be positioned to form a more compact structure.

Although the use of sheet metal is preferred to form the resonator element 40, the resonator element 40 may be formed using other technologies and techniques. For example, it is envisioned that the resonator element may be a dielectric material upon which conductive material has been applied such as, for example, thin film deposition techniques, including chemical vapor deposition (CVD), plating, depositing and/or growing electrically conducting materials and the like as well as electroplating techniques and electro-less plating techniques for coating resin-based, or plastic, structures with electrically conducting material may be employed to render a suitable, operable resonator element 40. In addition, the resonator may comprise several separate parts which are assembled into a unitary structured electrically conducting resonator element.

The slot wedge antenna assembly of the present invention is preferably tuned (as depicted and described herein) to operate over the 824–894 MHz frequency band which corresponds to the U.S. cellular frequency range, but the antenna assembly 30 as taught, enabled, described, illustrated and claimed herein may be optionally tuned to operate over other frequency bands or modified slightly so that the antenna assembly 30 operates over more than one frequency band (i.e., a multi-frequency antenna embodiment).

In use, the antenna assembly 30 may be adjusted by changing various attributes of the resonator element 40. For example, changing the angle 84 between the first and second conductive portions 50,60 will change the bandwidth. It is also possible to vary the bandwidth by making changes in the ground and feed attachment members 90,92, the notch feature 94, the slot width 96, the first conductive portion 50 and the length of the second conductive portion 60. And, the frequency may be varied by changing the overall side-to-side width or length (or both) for the second slot segment 100. In addition, the interior region 82 defined between first and second conductive portion 50,60 may receive therebetween a block of suitably shaped dielectric material. If desired, the volume of the interior region 82 may be increased or reduced by moving one or both of the first and/or second conductive portions 50,60 relative to the other. The angle 84 between first and second conductive portions 50,60 may be changed to tune the operating frequency and bandwidth of the resonator element 40 of the antenna assembly 30.

To create a multi-frequency band embodiment of the present invention, a extension slot feature may be added to the slot feature 96 (depicted in FIG. 3) to further elongate the first slot segment 98 beyond the second slot segment 100, so that a third slot segment (not depicted), of differing length from second slot segment 100, is formed in the resonator element 40. This third slot segment is preferably parallel to and spaced from the second slot segment 100. The resulting configuration of slot feature 96 fabricated according to this embodiment of the present invention will preferably appear in the shape of the capital letter "F" although a variety of configurations of and between the sub-components of slot feature 96 may be made. That is, the first slot segment 98 does not have to be "L-shaped" (i.e., orthogonal or perpendicular) relative to the second slot segment 100 and the second slot segment 100 need not be linear. In fact, the second slot segment 100 (and/or the third slot segment) can meander, or formed generally in the shape a wave pattern, to better achieve dual frequency response.

Additional advantages and modifications will readily occur to those skilled in the art. The invention in its broader aspects is, therefore, not limited to the specific details, representative apparatus and illustrative examples shown and described. Accordingly, departures from such details may be made without departing from the spirit or scope of the applicant's general inventive concept.

What is claimed:

1. An antenna assembly for use in a wireless communication device, the antenna assembly comprising:

a conductive resonator element having divergent portions defining an interior region therebetween, said resonator element including a first electrically conductive portion and a second electrically conductive portion, wherein the first electrically conductive portion has an elongate ground feed attachment location and an elongate radio signal feed attachment location, wherein the elongate ground feed attachment location and the elongate radio signal feed attachment location are spaced apart with an elongate notch feature disposed therebetween;

a ground plane operatively connected to the elongate ground feed attachment location of the first conductive portion; and, a source of radio frequency signals coupled to the elongate radio signal feed attachment location.

2. An antenna assembly of claim 1, further comprising an elongate slot beginning from an edge of the first electrically conductive portion and extending across the first electrically conductive portion and wherein said elongate slot terminates within the second electrically conductive portion.

3. An antenna assembly of claim 2, wherein the elongate slot includes a first slot segment joining a second slot segment and each said first slot segment and said second slot segment having a common slot width.

4. An antenna assembly of claim 3, wherein the first slot segment and the second slot segment are disposed substantially orthogonal to each other.

5. An antenna assembly of claim 3, wherein the first slot segment and the second slot segment are substantially rectilinear.

6. An antenna assembly of claim 5, wherein the first slot segment extends into and terminates within the second electrically conductive portion and the second slot segment is disposed entirely within the second electrically conductive portion.

7. An antenna assembly of claim 1, wherein the first conductive portion and the second conductive portion are generally planar and formed of metal.

8. An antenna assembly of claim 1, further comprising an electrically conducting element, the electrically conducting element operatively connecting the first conductive portion to the second conductive portion.

9. A resonator element for use with a wireless communication device, the resonator comprising:

a first conductive portion having a ground feed attachment location and a signal feed attachment location; and, a second conductive portion electrically coupled to the first conductive portion at a first side, wherein a second side is spaced from said first conductive portion in a gradually divergent configuration;

wherein the resonator element is electrically coupled to an RF signal line disposed in a wireless communication device, and wherein the resonator element is electrically coupled to a ground plane disposed in the wireless communication device, and wherein the ground feed attachment location and the signal feed attachment location define a notch feature therebetween.

10. A resonator element of claim 9, further comprising an elongate slot emanating from a first edge of said first conductive portion and extending across said first conductive portion.

11. The resonator element of claim 10, wherein the elongate slot includes a first segment and a second segment wherein the first segment is a substantially straight slot segment said second segment begins at the end of said first segment and said second segment extends at an angle relative to a centerline reference axis of said first segment.

12. A resonator element of claim 11, wherein the first segment and the second segment are disposed substantially perpendicular to each other.

13. A resonator element of claim 12, wherein the first segment and second segment are substantially linear and said first segment and said second segment both terminate within the second conductive portion.

14. A resonator element of claim 13, wherein the second segment extends across less that half of the width of the second conductive portion.

15. A resonator element of claim 9, wherein the first conductive portion and the second conductive portion are generally planar and fabricated from metallic material.

16. A resonator element for use with a wireless communication device, the resonator comprising:

a generally planar first conductive portion having a ground feed attachment location and a signal feed attachment location; and, a generally planar second conductive portion electrically coupled to the first conductive portion at a first side, wherein the first and second conductive portions are substantially nonparallel;

wherein the resonator element is electrically coupled at the signal feed attachment location to an RF signal line disposed in a wireless communication device, and wherein the resonator element is electrically coupled at the ground feed attachment location to a ground plane disposed in the wireless communication device, and wherein the ground feed attachment location and the signal feed attachment location define a notch feature therebetween.

17. A resonator element of claim 16, further comprising an elongate slot emanating from a first edge of said first conductive portion and extending across said first conductive portion.

* * * * *